US008860326B2

(12) United States Patent
Cahalane et al.

(10) Patent No.: US 8,860,326 B2
(45) Date of Patent: Oct. 14, 2014

(54) DIMMABLE LIGHT EMITTING DIODE LIGHTING SYSTEM

(71) Applicant: Electronic Theater Controls, Inc., Middleton, WI (US)

(72) Inventors: David J. Cahalane, Dane, WI (US); Joseph R. Bokelman, Fitchburg, WI (US)

(73) Assignee: Electronic Theatre Controls, Inc., Middleton, WI (US)

( * ) Notice: Subject to any disclaimer, the term of this patent is extended or adjusted under 35 U.S.C. 154(b) by 25 days.

(21) Appl. No.: 13/795,233

(22) Filed: Mar. 12, 2013

(65) Prior Publication Data

US 2013/0249405 A1 Sep. 26, 2013

Related U.S. Application Data

(60) Provisional application No. 61/613,726, filed on Mar. 21, 2012.

(51) Int. Cl.
*H05B 37/02* (2006.01)
*H05B 33/08* (2006.01)

(52) U.S. Cl.
CPC ..... *H05B 33/0845* (2013.01); *H05B 33/0815* (2013.01)
USPC ..... 315/291; 315/246; 315/185 R

(58) Field of Classification Search
CPC .... H05B 37/02; H05B 33/08; H05B 33/0803; H05B 33/0896; H05B 33/0833; H05B 33/0845
USPC ..... 315/185 R, 246, 291
See application file for complete search history.

(56) References Cited

U.S. PATENT DOCUMENTS

| | | | | |
|---|---|---|---|---|
| 4,797,599 | A | 1/1989 | Ference et al. | |
| 5,629,607 | A | 5/1997 | Callahan et al. | |
| 6,696,803 | B2 | 2/2004 | Tao et al. | |
| 6,727,661 | B2 | 4/2004 | Kominami et al. | |
| 7,358,679 | B2 | 4/2008 | Lys et al. | |
| 7,592,755 | B2 * | 9/2009 | Chen et al. | 315/291 |
| 7,633,779 | B2 | 12/2009 | Garrity et al. | |
| 7,667,408 | B2 | 2/2010 | Melanson et al. | |
| 7,764,028 | B2 | 7/2010 | Mariyama et al. | |
| 7,852,017 | B1 | 12/2010 | Melanson | |
| 7,902,761 | B2 | 3/2011 | Ang et al. | |
| 7,902,769 | B2 | 3/2011 | Shteynberg et al. | |

(Continued)

FOREIGN PATENT DOCUMENTS

JP 7006892 1/1995

*Primary Examiner* — Thuy Vinh Tran
(74) *Attorney, Agent, or Firm* — Michael Best & Friedrich LLP

(57) ABSTRACT

An LED lighting system including a first group of LEDs, a second group of LEDs, and a controller. The first group of LEDs and the second group of LEDs are configured to be independently driven by a first LED drive signal and a second LED drive signal, respectively. The controller is configured receive a dimming signal from a dimmer having a preheat function. The controller is also configured to compensate the dimming signal for the preheat function of the dimmer to generate a compensated dimming signal, generate the first LED drive signal based on the compensated dimming, and generate the second LED drive signal based on the compensated dimming signal. The first LED drive signal is then transmitted the first group of LEDs and the second LED drive signal is transmitted to the second group of LEDs.

20 Claims, 9 Drawing Sheets

(56) References Cited

U.S. PATENT DOCUMENTS

| | | | | |
|---|---|---|---|---|
| 7,956,553 | B2 * | 6/2011 | Chen et al. | 315/291 |
| 8,334,658 | B2 * | 12/2012 | Balakrishnan | 315/209 R |
| 8,492,992 | B2 * | 7/2013 | Otake et al. | 315/291 |
| 2009/0122580 | A1 | 5/2009 | Stamm et al. | |
| 2009/0160369 | A1 | 6/2009 | Godbole et al. | |
| 2009/0261748 | A1 | 10/2009 | McKinney et al. | |
| 2009/0295300 | A1 | 12/2009 | King | |
| 2010/0060187 | A1 | 3/2010 | Newman, Jr. et al. | |
| 2010/0109548 | A1 | 5/2010 | Matsuda | |
| 2010/0123410 | A1 | 5/2010 | Tsai | |
| 2010/0134038 | A1 | 6/2010 | Shackle et al. | |
| 2010/0207536 | A1 | 8/2010 | Burdalski et al. | |
| 2010/0231136 | A1 | 9/2010 | Reisenauer et al. | |
| 2010/0237790 | A1 | 9/2010 | Peng | |
| 2010/0259183 | A1 | 10/2010 | Leshniak | |
| 2010/0259196 | A1 | 10/2010 | Sadwick et al. | |
| 2010/0295478 | A1 | 11/2010 | Wei et al. | |
| 2011/0001766 | A1 | 1/2011 | Hua et al. | |
| 2011/0074306 | A1 | 3/2011 | Tai | |
| 2014/0070710 | A1 * | 3/2014 | Harris | 315/185 R |

* cited by examiner

*FIG. 7*

| | | | | | |
|---|---|---|---|---|---|
| A | A | A | A | A | A |
| A | B | A | A | B | A |
| A | A | B | B | A | A |
| A | A | B | B | A | A |
| A | B | A | A | B | A |
| A | A | A | A | A | A |

310

*FIG. 8*

| | | | | | |
|---|---|---|---|---|---|
| A | A | A | A | A | A |
| A | B | B | B | B | A |
| A | B | A | A | B | A |
| A | B | A | A | B | A |
| A | B | B | B | B | A |
| A | A | A | A | A | A |

315

*FIG. 9*

| | | | | |
|---|---|---|---|---|
| A | A | A | A | A |
| A | B | B | B | A |
| A | B | C | B | A |
| A | B | B | B | A |
| A | A | A | A | A |

320

*FIG. 10*

| | | | | |
|---|---|---|---|---|
| A | A | A | A | A |
| A | B | C | B | A |
| A | C | B | C | A |
| A | B | C | B | A |
| A | A | A | A | A |

325

DIMMABLE LIGHT EMITTING DIODE LIGHTING SYSTEM

RELATED APPLICATIONS

This application claims the benefit of U.S. Provisional Patent Application No. 61/613,726, filed Mar. 21, 2012, the entire content of which is hereby incorporated by reference.

BACKGROUND

This invention relates to dimming an output of a light fixture. Some incandescent light sources can be damaged by large inrush currents when switching from an "OFF" state to a full "ON" state. To remedy this danger for such incandescent light sources, a preheat function or technique is used to maintain the incandescent light source in the "ON" state (e.g., the light source being driven at an arbitrarily low value, such as 5%). The preheat technique keeps the light source from cooling to a point where a large inrush current may be damaging. Additionally, by maintaining the incandescent light source in a continuous "ON" state, the light source is able to react more quickly to changes in input power. The preheat technique is accomplished using, for example, a triode for alternating current ("TRIAC") or a silicon-controlled rectifier ("SCR").

SUMMARY

Commercially available dimming systems for light-emitting diode ("LED") lighting suffer from poor dimming performance at various stages throughout a dimming cycle (i.e., from an "OFF" state to a maximum "ON" state), and typically "bump" LEDs on initially before fading back down to a proper output level. Such dimming systems exhibit particularly poor performance at the low-end of the dimming cycle (e.g., between 80% dimming and 100% dimming), in part, because LEDs have a threshold or on-voltage that must be met or exceeded in order for the LED to emit light. This threshold voltage can result in abrupt transitions from a non-emitting condition to an emitting condition at the low-end of a dimming cycle, and makes the performance of the dimmer "steppy" or inconsistent.

The invention provides improved dimming performance for a light fixture at the low-end of the dimming cycle by using a preheat function with the LED light fixture and, based on a single dimming signal, generating multiple drive signals to independently drive at least two groups of LEDs. For example, a pulse-width modulation ("PWM") signal corresponding to a desired dimming level is software-corrected to remove the effects of the preheat function of a conventional dimmer (e.g., a dimmer for an incandescent light source). As such, the dimmer remains in an on or conductive state, but without activating the LEDs in the LED fixtures. By software correcting the PWM signal, the LED lighting system can respond more quickly to changes in dimming level because the dimmer remains in a conductive state while the LEDs in the fixtures remain off. Additionally, the LED lighting system can be configured to generate multiple LED drive signals for controlling multiple groups of LEDs within the lighting system or a lighting fixture based on the dimming signal. By generating multiple LED drive signals from the dimming signal, a first group of LEDs may be turned on or off sooner than a second group of LEDs. Such a dimming control technique allows the LED fixtures to be dimmed from the conventional dimmers described above without, for example, having to run both power and control wiring to a fixture (e.g., without having to provide power continuously to a fixture and separately providing DMX control signals to the fixture).

In one embodiment, the invention provides an LED lighting system. The lighting system includes a dimmer, a dimming controller, a software controller, and an LED driver module. The dimmer has a preheat function and is configured to generate a dimming signal. A first group of LEDs and a second group of LEDs are configured to be independently driven by a first LED drive signal and a second LED drive signal, respectively. The dimming controller is configured to receive the dimming signal from the dimmer and generate a first pulse-width modulated ("PWM") signal based on the dimming signal. The first PWM signal has a first duty cycle. The software controller is in electrical communication with the dimming controller. The software controller is configured to receive the first PWM signal from the dimming controller and compensate the first PWM signal for the preheat function of the dimmer to generate a second PWM signal. The second PWM signal has a second duty cycle, and the second duty cycle is different than the first duty cycle. The LED driver module is configured to receive the second PWM signal, generate the first LED drive signal associated with a drive level of the first group of LEDs and based on the second PWM signal, generate the second LED drive signal associated with a drive level of the second group of LEDs and based on the second PWM signal, and transmit the first LED drive signal to the first group of LEDs and the second LED drive signal to the second group of LEDs.

In another embodiment, the invention provides an LED lighting system that includes a first group of LEDs, a second group of LEDs, and a controller. The first group of LEDs and the second group of LEDs are configured to be driven by a first LED drive signal and a second LED drive signal, respectively. The controller is configured to be in electrical communication with the first group of LEDs and the second group of LEDs, and receive a dimming signal associated with a dimmer having a preheat function. The controller is also configured to compensate the dimming signal for the preheat function of the dimmer to generate a compensated dimming signal, generate the first LED drive signal based on the compensated dimming signal, and generate the second LED drive signal based on the compensated dimming signal. The first LED drive signal is associated with a drive level of the first group of LEDs, and the second LED drive signal is associated with a drive level of the second group of LEDs. The controller is also configured to transmit the first LED drive signal to the first group of LEDs and the second LED drive signal to the second group of LEDs.

In another embodiment, the invention provides a method of controlling dimming in an LED lighting system. The method includes receiving a dimming signal, generating a first PWM signal having a first duty cycle and based on the dimming signal, and compensating the first PWM signal for a preheat function of a dimmer to generate a second PWM signal. The second PWM signal has a second duty cycle, and the second duty cycle is different than the first duty cycle. The method also includes generating a first LED drive signal associated with a drive level of a first group of LEDs and based on the second PWM signal, generating a second LED drive signal associated with a drive level of a second group of LEDs and based on the second PWM signal, and transmitting the first LED drive signal to the first group of LEDs and the second LED drive signal to the second group of LEDs.

Other aspects of the invention will become apparent by consideration of the detailed description and accompanying drawings.

BRIEF DESCRIPTION OF THE DRAWINGS

FIGS. 5-10 illustrate arrangements of LED groups capable of being used with the systems of FIGS. 1-4.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

The invention relates to dimming control in a light-emitting diode ("LED") lighting system. For example, the lighting system includes a conventional dimmer (e.g., a conventional AC dimmer having a preheat function). Unlike the incandescent lamps that such a dimmer was designed to control, LED lighting systems may exhibit inconsistent dimming performance through the full range of dimming of the LED fixtures. Also unlike incandescent lamps, LEDs do not benefit from the preheat function of the dimmer because LEDs have a minimum threshold, or on-voltage, that must be satisfied before the LEDs turn on, which may contribute to poor low-end dimming performance (e.g., between 80% dimming and 100% dimming). To improve the low-end dimming performance of LED fixtures in an LED lighting system, a pulse-width modulation ("PWM") signal corresponding to a desired dimming level is software-corrected to remove the effects of the preheat function of the conventional dimmer. As such, the dimmer remains in an on or conductive state, but without activating the LEDs in the LED fixtures. The software-corrected PWM signal allows the LED lighting system to quickly respond to changes in dimming level because the dimmer remains in a conductive state while the LEDs in the fixtures remain off. Additionally, the LED lighting system is configured to generate multiple LED drive signals for controlling multiple groups of LEDs within the same fixture. By generating multiple LED drive signals based on the dimming signal, a first group of LEDs may be turned on or off sooner than a second group of LEDs, thus further improving the low-end dimming performance of the LED lighting system.

Figure 1:
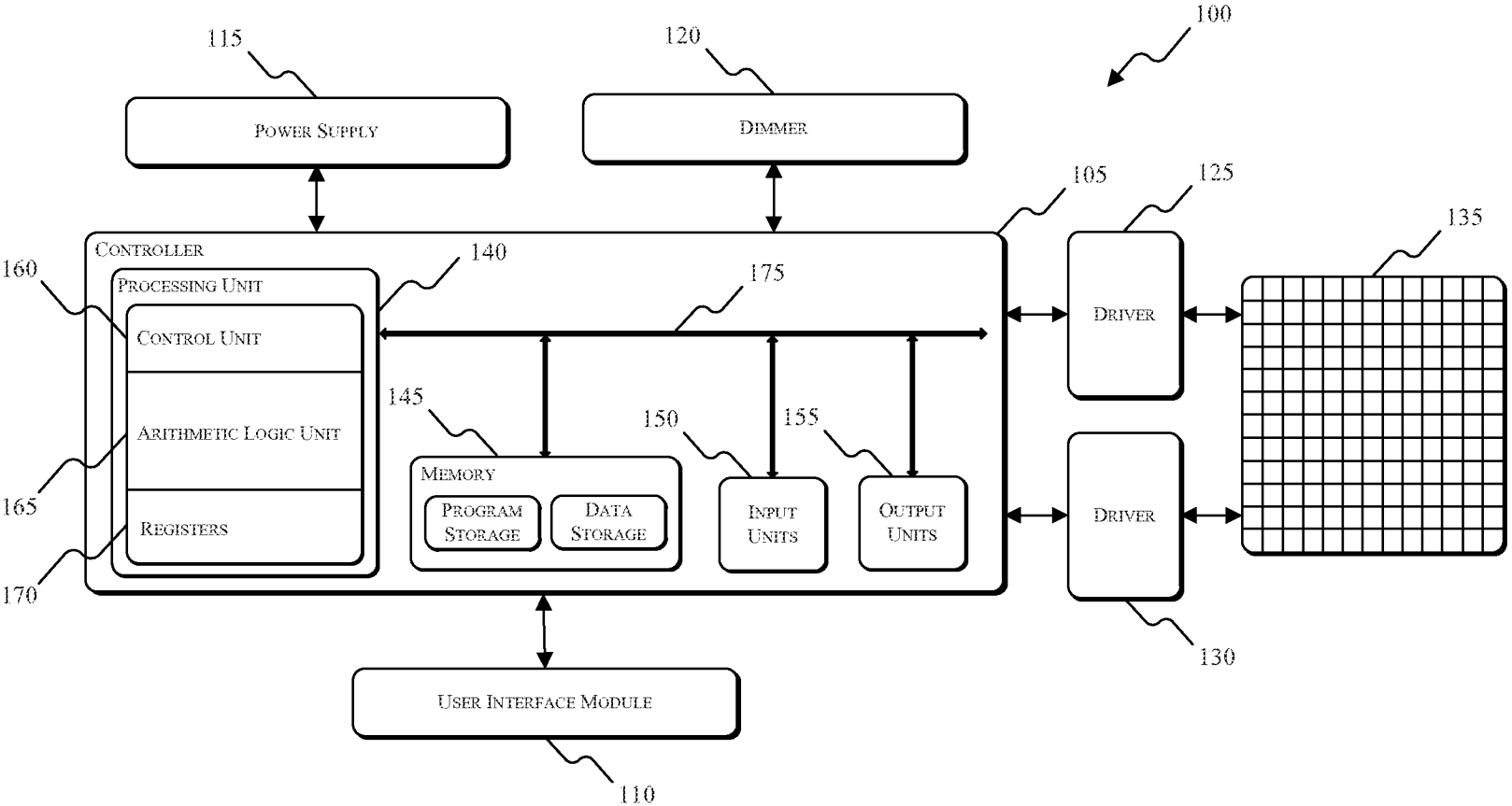
FIG. 1 illustrates a lighting system according to an embodiment of the invention.

A lighting system 100 for implementing such dimming control techniques is illustrated in FIG. 1. The lighting system 100 of FIG. 1 includes a controller 105 associated with the lighting system 100 and electrically and/or communicatively connected to a variety of modules or components of the lighting system 100. For example, the illustrated controller 105 is connected to a user interface module 110, a power supply module 115, a dimmer 120, a first driver 125, a second driver 130, and a lighting array 135. In some constructions, the lighting array 135 includes multiple groups of LEDs such that a first group of the LEDs receives drive signals from the first driver 125 and a second group of LEDs receives drive signals from the second driver 130. The controller 105 includes combinations of hardware and software that are operable to, among other things, control the operation of the lighting system 100, an output intensity of the light sources in the lighting array 135, information displayed in the user interface 110, etc.

The controller 105 includes a plurality of electrical and electronic components that provide power, operational control, and protection to the components and modules within the controller 105 and/or lighting system 100. For example, the controller 105 includes, among other things, a processing unit 140 (e.g., a microprocessor, a microcontroller, or another suitable programmable device), a memory 145, input units 150, and output units 155. The processing unit 140 includes, among other things, a control unit 160, an arithmetic logic unit ("ALU") 165, and a plurality of registers 170 (shown as a group of registers in FIG. 1), and is implemented using a known computer architecture, such as a modified Harvard architecture, a von Neumann architecture, etc. The processing unit 140, the memory 145, the input units 150, and the output units 155, as well as the various modules connected to the controller 105 are connected by one or more control and/or data buses (e.g., common bus 175). The control and/or data buses are shown generally in FIG. 1 for illustrative purposes. The use of one or more control and/or data buses for the interconnection between and communication among the various modules and components would be known to a person skilled in the art in view of the invention described herein.

The memory 145 includes, for example, a program storage area and a data storage area. The program storage area and the data storage area can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices. The processing unit 140 is connected to the memory 145 and executes software instructions that are capable of being stored in a RAM of the memory 145 (e.g., during execution), a ROM of the memory 145 (e.g., on a generally permanent basis), or another non-transitory computer readable medium such as another memory or a disc. Software included in the implementation of the lighting system 100 can be stored in the memory 145 of the controller 105. The software includes, for example, firmware, one or more applications, program data, filters, rules, one or more program modules, and other executable instructions. The controller 105 is configured to retrieve from memory and execute, among other things, instructions related to the control processes and methods described herein. In other constructions, the controller 105 includes additional, fewer, or different components.

The power supply module 115 supplies a nominal AC or DC voltage to the controller 105 or other components or modules of the lighting system 100. The power supply module 115 is powered by, for example, a power source having nominal line voltages between 100V and 240V AC and frequencies of approximately 50-60 Hz. The power supply module 115 is also configured to supply lower voltages to operate circuits and components within the controller 105 or lighting system 100. In other constructions, the controller 105 or other components and modules within the lighting system 100 are powered by one or more batteries or battery packs, or another grid-independent power source (e.g., a generator, a solar panel, etc.).

Figure 2:
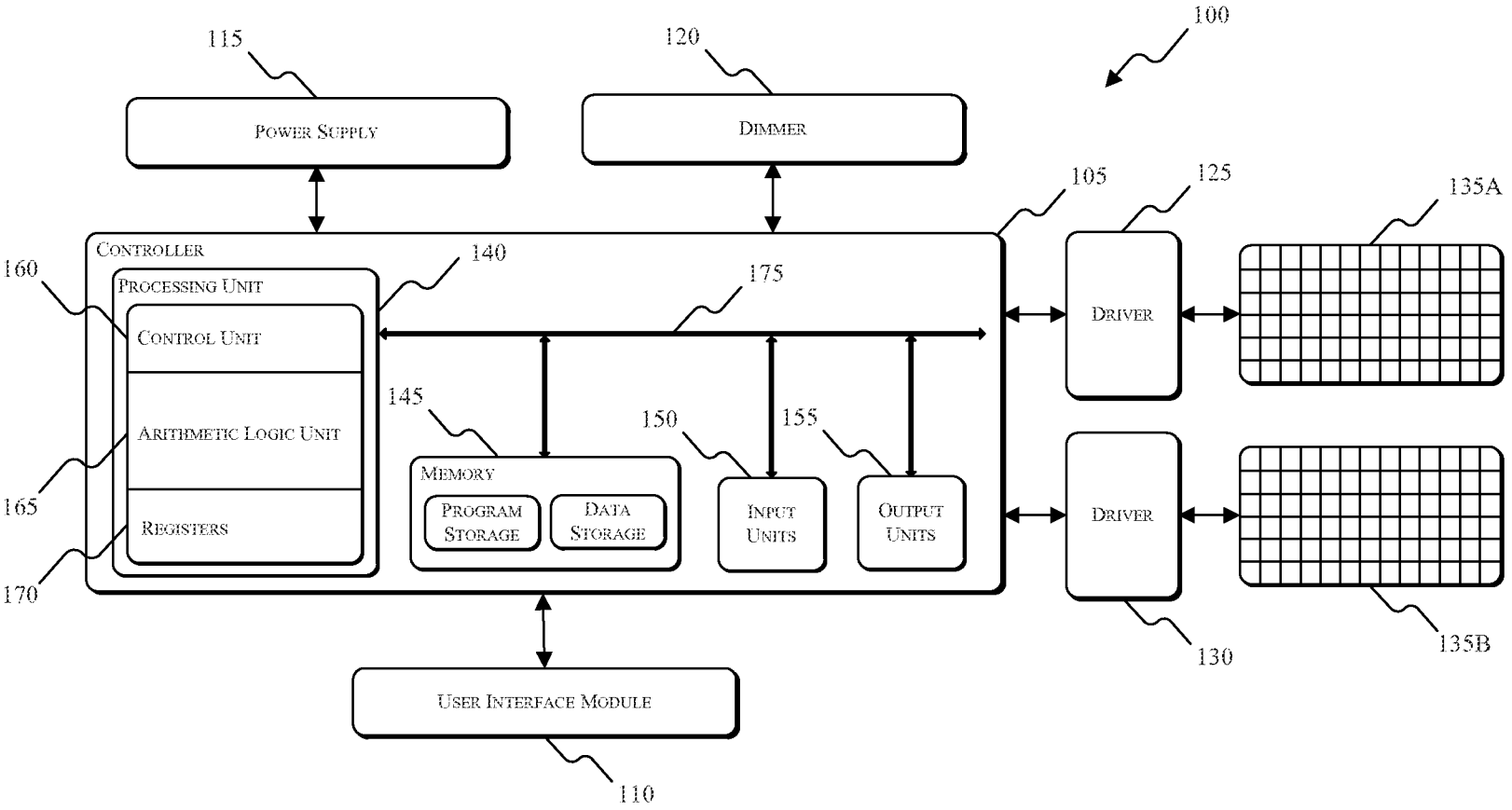
FIG. 2 illustrates a lighting system according to another embodiment of the invention.

The user interface module 110 is used to control or monitor the lighting system 100. For example, the user interface module 110 is operably coupled to the controller 105 to control the color output of the lighting array 135. In some constructions, the user interface module 110 includes a combination of digital and analog input or output devices required to achieve a desired level of control and monitoring for the lighting system 100. For example, the user interface module 110 includes a display (e.g., a monitor) and input devices such as touch-screen displays, a plurality of knobs, dials, switches, buttons, etc. The display is, for example, a liquid crystal display ("LCD"), a light-emitting diode ("LED") display, an organic LED ("OLED") display, etc. The user interface module 110 can also be configured to display conditions or data associated with the lighting system 100 in real-time or substantially real-time. For example, the user interface module 110 is configured to display characteristics or properties of the lighting system 100, the status of the lighting system 100, the output of the lighting array 135, etc. In some implementations, the user interface module 110 is controlled to provide visual or auditory indications of the status or conditions of the lighting system 100. FIG. 2 illustrates substantially the same lighting system 100 as shown in and described above with respect to FIG. 1, and like elements are identified with like numbers. However, FIG. 2 illustrates the lighting system 100 such that the first and second drivers 125 and 130 provide drive signals to first and second LED arrays 135A and 135B, respectively. In such a construction, both the first driver 125 and the second driver 130 are configured to generate multiple drive signals to drive multiple groups of LEDs in each of the LED arrays 135A and 135B.

Figure 3:
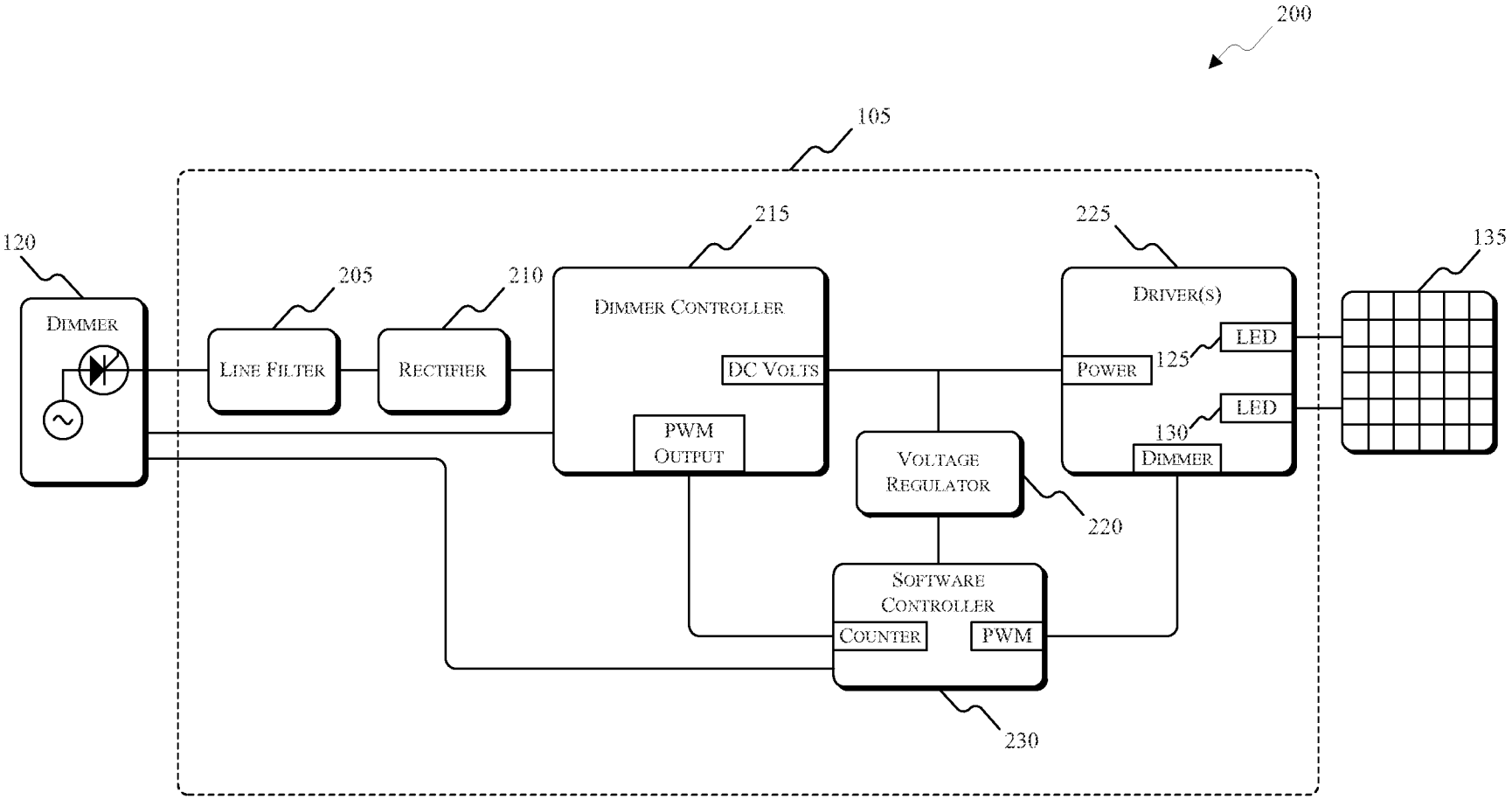
FIG. 3 illustrates a dimming control system according to an embodiment of the invention.

FIG. 3 illustrates a dimming control system 200 that includes the dimmer 120, the controller 105, and the LED array 135. In the illustrated construction, the controller 105 includes the first LED driver 125 and the second LED driver 130 of FIGS. 1 and 2 internally. The controller 105 also includes a line filter 205, a rectifier 210, a dimmer controller 215, a voltage regulator 220, an LED driver module 225, and a software controller 230. The dimmer 120 is a conventional dimmer for use with any of a variety of loads, such as the Sensor+ SineWave Dimmer or the Unison Dimmer, both commercially available from Electronic Theatre Controls, Middleton, Wis. The dimmer 120 includes a preheat function that is enabled to maintain the dimmer 120 and associated electronics in an energized state. The level of preheat that is employed by the dimmer 100 is set based on, for example, a particular dimming application, characteristics or specifications of the associated electronics, etc.

In some implementations, if the power required by a lighting system 200 is higher than what can be provided (e.g., when the dimmer 120 transitions quickly from a bright state to a dim state), the LED driver 225 quickly transitions (e.g., snaps, steps, etc.) the LEDs to the new dimming state. When this occurs, it is difficult to achieve smooth dimming operation because the LEDs require more power for dimming than the input from the dimmer controller 215 is capable of providing. In such instances, dimmer doubling can be used to provide a complete AC half-cycle for power delivery and a second half-cycle for dimming data (i.e., to control dimming), and each half-cycle can be controlled independently. Dimmer doubling is a feature of the dimmer 120 (e.g., dimmer doubling is available in some dimmers and not others) at the input power side of a lighting system 200. Dimmer doubling enables the LED driver 225 to provide more power to the LEDs to allow the LEDs to dim smoothly even when the dimmer quickly transitions from a bright state to a dim state. In some embodiments, dimmer doubling in the lighting system 200 is implemented such that, if dimmer doubling from the dimmer 120 is available, it is automatically implemented. If dimmer doubling is not available from the dimmer 120 (i.e., each half-cycle corresponds to the same duty cycle and are not controlled independently), the system 200 uses either the positive half-cycle or negative half-cycle to control dimming.

For example, when using dimmer doubling, the positive half-cycle of an input power signal is set at full power (e.g., 100% power), and the negative half-cycle of the input power signal is independently set at a second power level that corresponds to a desired level of dimming. As a result, the positive half-cycle and the negative half-cycle of the input power signal can correspond to independent duty cycles or conduction angles. The dimmer controller 215 receives both half-cycles following filtering and rectification, and combines the power from both half-cycles to deliver as much power to the LED driver 225 as possible. When implementing dimmer doubling, the software controller 230 recognizes, determines, or otherwise distinguishes between the half-cycle that is being used only to provide power and the half-cycle that is being used to control dimming. For example, the software controller 230 receives a signal from the dimmer 120 or the dimmer controller 215 related to which half-cycle is the control half-cycle, a signal related to the desired level of dimming, etc., and correspondingly controls the dimming of the LEDs.

In the illustrated construction, the voltage regulator 220 is configured to provide a regulated voltage (e.g., 3.3V, 5V, etc.) to the dimmer controller 215, the software controller 230, and the LED driver module 225. The voltage regulator 220 can also be used to provide regulated voltages of varying levels to other modules or components of the dimming control system 200. The line filter 205 is configured to attenuate radio frequency or electromagnetic interference between the AC input line voltage and the controller 105. The rectifier 210 is, for example, a bridge rectifier that provides full-wave rectification of the AC input signal. Although not illustrated in FIG. 3, the controller 105 may also include one or more capacitors or other electric or electronic components for smoothing the output of the rectifier 210. The output of the rectifier 210 is then provided to the dimmer controller 215, such as the LM3450, commercially available from Texas Instruments™, Dallas, Tex. The dimmer controller 215 is configured to provide, for example, power factor correction of the dimming signal. The dimmer controller 215 is also configured to map the received dimming signal to a PWM output signal (e.g., a 500 Hz PWM output signal) corresponding to the dimming signal and including an offset from the preheat function of the dimmer 120. The output of the dimmer controller 215 is provided to the software controller 230.

The software controller 230 includes, among other things, a counter for determining the duty cycle of the PWM output from the dimmer controller 215. For example, the counter determines the pulse width of the incoming PWM signal from the dimmer controller 215 using a high frequency counter signal (e.g., relative to the incoming PWM signal) to count the number of pulses between rising and falling edges of the incoming PWM signal. In some constructions an internal clock signal for the software controller 230 is used. In other constructions, the frequency of the pulses is varied or programmed based on a desired resolution for which the pulse width is to be determined. By determining the number of pulses of the count signal between rising and falling edges of the incoming PWM signal, the software controller 230 can calculate or determine the duty cycle of the incoming PWM signal. Additionally or alternatively, the dimmer controller 215 sends, or provides to, the software controller a signal indicative of a PWM signal that would be generated based on the diming signal, but does not actually generate the first PWM signal.

Based on the determined duty cycle, the software controller 230 is configured to generate a compensated PWM signal having a second duty cycle value. For example, the second duty cycle value is less than the first duty cycle value because the software controller 230 compensates the first duty cycle value for the applied voltage used to achieve the preheat function of the dimmer 120. In some constructions, the level of preheat utilized by the dimmer 120 is programmed into the software controller 230. In other constructions, the dimmer 120 and the software controller 230 are communicatively connected (e.g., by a wired or wireless connection) such that the level of preheat used by the dimmer 120 is received or determined by the software controller 230. The software controller 230 outputs a second PWM signal (e.g., a 1.2 kHz or greater PWM signal) corresponding to the second duty cycle value to the LED driver module 235. As illustrated in FIG. 3, the software controller 230 outputs only the second PWM signal to the LED driver module 225 (i.e., a single PWM signal). In some constructions, the software controller 230 is also operable to detect and compensate for SCR misfires.

Figure 4:
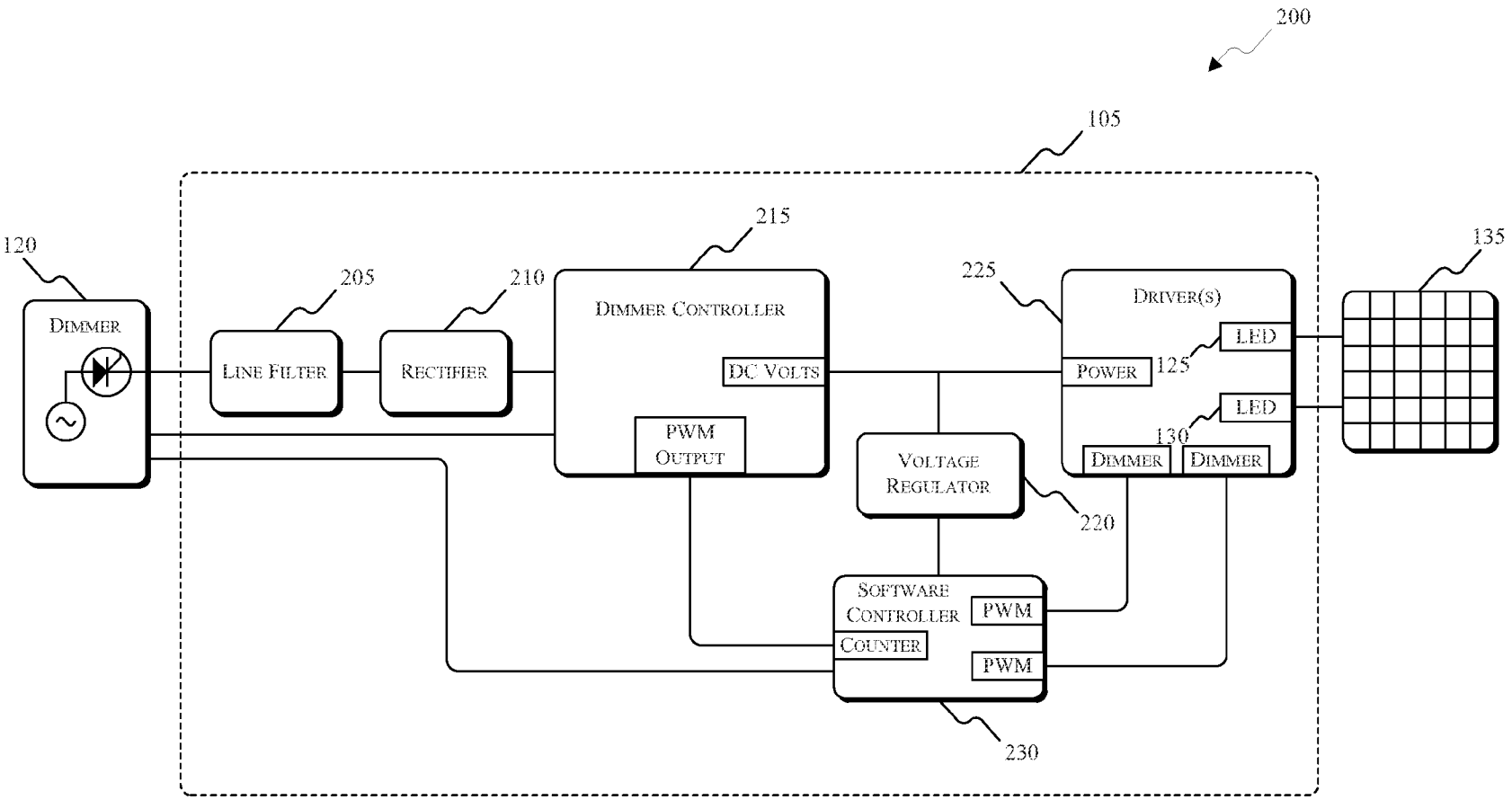
FIG. 4 illustrates a dimming control system according to another embodiment of the invention.

In the construction illustrated in FIG. 4, the software controller 230 is configured to output both a second PWM signal and a third PWM signal to the LED driver module 225. In constructions in which the software controller 230 outputs only the second PWM signal to the LED driver module 225 (FIG. 3), the LED driver module 225 is configured to generate first and second drive signals for driving a first group of LEDs and a second group of LEDs based on the second PWM signal. However, in constructions in which the software controller 230 outputs the second PWM signal and a third PWM signal, the LED driver module 225 receives the two PWM signals separately and can use the two PWM signals to directly generate the drive signals for the first group of LEDs and the second group of LEDs. In other implementations, the software controller 230 or the LED driver module 225 can be configured to generate any number of additional PWM signals or LED drive signals (e.g., two or more), respectively, in order to drive additional groups of LEDs.

As an illustrative example, the LED driver module 225 can be configured to evaluate a received PWM signal from the software controller 230. Depending on the duty cycle of the received PWM signal, the LED driver module 225 generates first and second drive signals for the first and second groups of LEDs. If the duty cycle of the received PWM signal is sufficiently large (e.g., corresponding to a dimming signal of between approximately 0% dimming [i.e., 100% LED output] and 80% dimming [i.e., 20% LED output]), the first and second drive signals may have the same drive value. However, when the PWM signal from the software controller 230 corresponds to a dimming signal above a threshold dimming value of, for example, approximately 90%, the drive signals generated by the LED driver module 225 are different. By generating different drive signals, some of the LEDs in the lighting array 135 will be turned off sooner than other LEDs in the lighting array 135. By varying the times at which different groups of LEDs are turned off, lighting system is able to produce smooth and consistent low-end dimming (e.g., between 90% dimming and 100% dimming) of the lighting array 135. In some implementations, a threshold dimming value greater than or less than approximately 80% is used. For example, the threshold dimming value can have a value of between approximately 80% and approximately 100% or between approximately 50% and approximately 80%. In other implementations, the first and second drive signals are different throughout the full range of dimming (i.e., for any desired output less than a 100% maximum output). The threshold dimming value can be set, established, selected, or programmed such that the lighting system 200 produces the smoothest and most consistent dimming throughout a dimming range from 0% dimming (i.e., 100% LED output) to 100% dimming (i.e., 0% LED output). A dimming threshold value of 90% is used as an exemplary value because 90% dimming is a point at which many LED dimmers become "steppy" and inconsistent, as previously described.

In other implementations, the LED driver module 225 is configured to generate a drive signal that is switched between the first group of LEDs and the second group of LEDs. For example, the software controller 230 generates the second PWM signal, which is sent to the LED driver module 225. The LED driver module 225 then generates an LED drive signal that is provided to either the first group of LEDs or the second group of LEDs based on the desired level of dimming. The first group of LEDs may include, for example, the full array of LEDs in the LED array 135. The second group of LEDs may then include, for example, a subset of the full array of LEDs in the LED array 135. In some constructions, the second group of LEDs is not a subset of the first group of LEDs. As a result, the LED driver module 225 switches the application of the LED drive signal between the first group of LEDs and the second group of LEDs to achieve the desired dimming. In such implementations, one of the first group of LEDs and the second group of LEDs receives the LED drive signal related to the desired output of the LEDs, and the second group of LEDs receives a NULL LED drive signal. Additionally, in some implementations, the duty cycle of the LED drive signal can be modified when the output of the LED drive is switched between the first group of LEDs and the second group of LEDs. For example, the first group of LEDs is driven with an LED drive signal having a first duty cycle, and the second group of LEDs is driven with an LED drive signal having a second duty cycle that is different than the first duty cycle.

In the construction illustrated in FIG. 4, the software controller 230 can be configured to evaluate the compensated PWM signal from the dimmer controller 215 (i.e., after the PWM signal has been corrected for the preheat function of the dimmer or after the necessary correction has been determined). Depending on the duty cycle of the compensated PWM signal, the software controller 230 generates the second and third PWM signals for the first and second groups of LEDs. If the duty cycle of the compensated PWM signal is sufficiently large (e.g., corresponding to a dimming signal of between approximately 0% dimming [i.e., 100% LED output] and 80% dimming [i.e., 20% LED output]), the first and second drive signals may have the same drive value. However, when the compensated PWM signal corresponds to a dimming signal above the threshold dimming value as described above, the PWM signals generated by the software controller 230 have different duty cycles. By generating multiple PWM signals having different duty cycle values, the LED driver module 225 will generate corresponding drive signals such that some of the LEDs in the lighting array 135 will be turned off sooner than other LEDs in the lighting array 135. By varying the times at which different groups of LEDs are turned off, lighting system 200 is able to produce smooth and consistent low-end dimming (e.g., between approximately 80% dimming and 100% dimming) of the lighting array 135.

Figure 5:
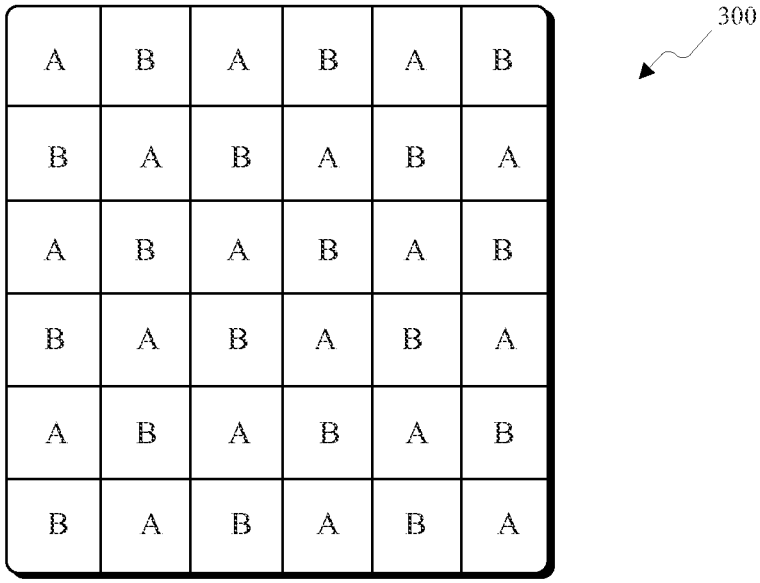
Figure 6:
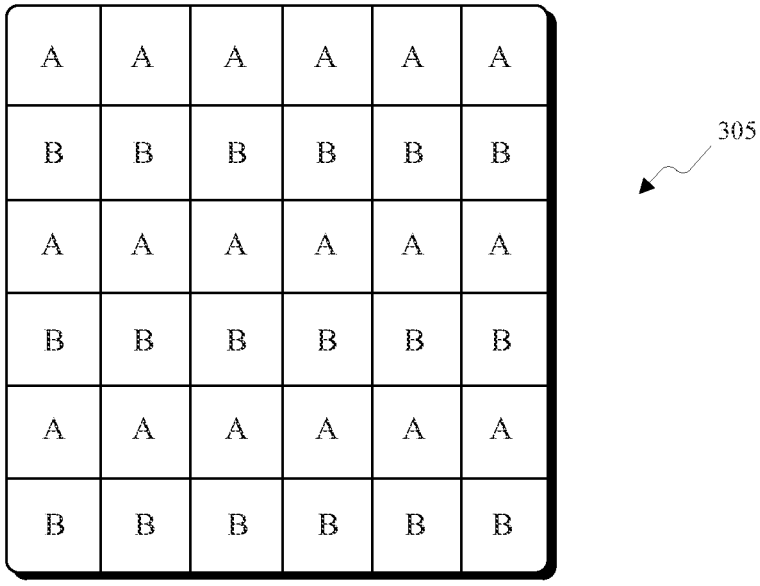

The multiple drive signals generated by the LED drive module can be used to control the groups of LEDs in the LED lighting array 135 or arrays 135A and 135B in a variety of ways. For example, FIGS. 5-8 illustrate constructions in which the LED array 135 or the LED arrays 135A and 135B include two independent groups of LEDs. By providing the independent drive signals to the respective groups of LEDs, one group of LEDs can be turned off or dimmed at a faster rate or sooner than the other group, thus achieving improved dimming performance. In FIG. 5, an exemplary array 300 of LEDs is illustrated. The array 300 is divided into a first group of LEDs, GROUP A, and a second group of LEDs, GROUP B. In the construction illustrated in FIG. 5, the GROUP A LEDs and the GROUP B LEDs are alternated for each row and column. As the level of dimming increases (e.g., dimming between 90% and 100%), the output intensity values of the GROUP B LEDs can be reduced at a faster rate or sooner than the GROUP A LEDs. In the construction illustrated in FIG. 6, the GROUP A LEDs and the GROUP B LEDs are alternated by row (i.e., a first row contains GROUP A LEDs and a second row contains GROUP B LEDs). Alternatively, a first column can include GROUP A LEDs and a second column can include GROUP B LEDs. In some constructions, such groupings may be exclusive to each row or column. In other constructions, each row or column includes a both GROUP A and GROUP B LEDs that are alternated (e.g., six GROUP A LEDs, six GROUP B LEDs, six GROUP A LEDs, etc.). Such a pattern is repeated for each row or column of LEDs in the LED array. The numbers of LEDs from each group that are adjacent to one another can vary arbitrarily. For example, two or more of the same group of LEDs are adjacent to one another in each row or column.

FIGS. 7 and 8 illustrate additional patterns for grouping LEDs in the LED array 135 or the arrays 135A and 135B. In FIG. 7, an array 310 of LEDs includes GROUP A LEDs around an outer edge of the array and a crossing pattern of GROUP B LEDs in the interior of the array 310. FIG. 8 illustrates an array 315 in which the GROUP A and GROUP B LEDs are arranged in concentric alternating squares of LEDs (e.g., a GROUP A square of LEDs, a GROUP B square of LEDs, and a second GROUP A square of LEDs). For each of the implementations illustrated in FIGS. 7 and 8, the arrays 310 and 315 can be repeated as necessary to fill the full LED array 135 or arrays 135A and 135B.

FIGS. 9 and 10 illustrate LED groupings for implementations that include three groups of LEDs. For example, in addition to the GROUP A LEDs and the GROUP B LEDs, the array 135 or arrays 135A and 135B can also include GROUP C LEDs. The configurations of the LED arrays including GROUP A, GROUP B, and GROUP C LEDs are similar to those described above with respect to the arrays that included only GROUP A and GROUP B LEDs. However, by adding the GROUP C LEDs, additional dimming precision can be achieved. For example, three independent drive signals can be generated to control the GROUP A, GROUP B, and GROUP C LEDs. As an illustrative example, the drive signals for the GROUP A, GROUP B, and GROUP C LEDs are substantially the same or similar for a dimming range from approximately 0% dimming to approximately 90% dimming. From approximately 90% dimming to approximately 95% dimming, the output intensity values of the GROUP B and GROUP C LEDs are reduced at a greater rate or sooner than the GROUP A LEDs. Then, from approximately 95% dimming to approximately 100% dimming, the output intensity values of the GROUP C LEDs are reduced at a greater rate or sooner than both the GROUP A LEDs and the GROUP B LEDs. As a result, each of the GROUP A LEDs, GROUP B LEDs, and GROUP C LEDs are reduced to an output intensity value of zero at different times or at different rates. The staggered dimming of the groups of LEDs at the low-end dimming values allows for consistent dimming throughout the full dimming range (i.e., 0% dimming to 100% dimming). In FIG. 9, an array 320 of concentric squares is illustrated as a square of GROUP A LEDs, a square of GROUP B LEDs, and a square of GROUP C LEDs. In FIG. 10, GROUP A LEDs are positioned along an outer edge of an array 325 and GROUP B and GROUP C LEDs are alternated inside of the GROUP A LEDs (e.g., alternated such that there are more GROUP B LEDs than GROUP C LEDs). For each of the implementations illustrated in FIGS. 9 and 10, the arrays 320 and 325 can be repeated as necessary to fill the full LED array 135 or arrays 135A and 135B.

Although, the arrays of LEDs in FIGS. 5-10 are illustrative, other arrays of LEDs and patterns of GROUP A, GROUP B, GROUP C, etc., LEDs can be used to achieve the desired level of low-end dimming precision. In some implementations, four or more (e.g., between four and approximately 100) different groupings of LEDs can be used. Such groupings of LEDs can be implemented in a manner similar to that described above with respect to the two and three LED grouping implementations. In such implementations, the software controller 230 or the LED driver module 225 is configured (i.e., are scaled to include the combination of hardware and software that is necessary) to generate additional PWM signals or additional drive signals to drive each of the different groups of LEDs.

For example, each dimming level that can be selected by a user or the controller 105 corresponds to output intensity values for each group of LEDs. In one construction, the dimming of each of the groups of LEDs is implemented by indexing a desired dimming level into tables of intensities required for each group of LEDs to generate the desired dimming level. In other implementations, the dimming is implemented using a function that converts the desired level of dimming into the required drive levels for each group of LEDs. For example, the tables required to implement a dimming system that includes a plurality of groups of LEDs can become large or cumbersome as the number of groups of LEDs increases. In such an instance, a function that calculates the necessary drive levels for the groups of LEDs based on a desired dimming level is used in place of or in conjunction with a table. For example, a look-up table may be used for dimming levels between 0% dimming and 90% dimming when each group of LEDs is driven with approximately the same or similar drive signals. Then, when dimming levels of between 90% and 100% are desired, the function is used to calculate the necessary drive levels for the groups of LEDs.

Figure 11:
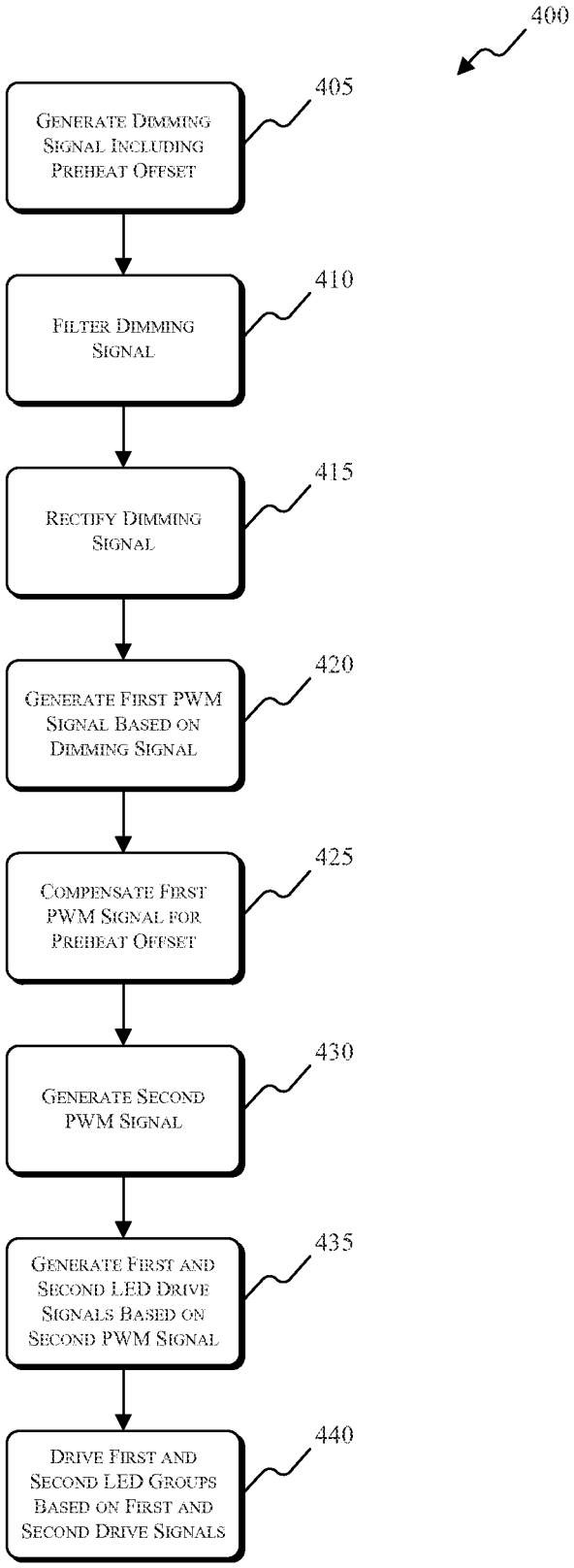
FIG. 11 illustrates a process for controlling the dimming of a lighting system according to an embodiment of the invention.

A process 400 for enhancing low-end dimming of a lighting system as described above is illustrated in FIG. 11. At step 405, a dimming signal is generated that includes an offset from the preheat function of the dimmer 120. The generated dimming signal is received by the controller 105 and filtered (step 410) by the line filter 205 to remove or reduce noise in the dimming signal (e.g., a voltage signal). The filtered dimming signal is then rectified (step 415). The rectified dimming signal is received at the dimmer controller 215, which generates a first PWM signal (step 420) based on the rectified dimming signal. The first PWM signal is provided to the software controller 230, which compensates the duty cycle of the first PWM signal for the preheat function of the dimmer 120 (step 425). For example, as previously described, the duty cycle of the first PWM signal is determined and reduced in correspondence with the magnitude of the voltage or current offset from the preheat function. The software controller 230 then generates a second PWM signal having a duty cycle corresponding to the compensated first PWM signal (step 430). The second PWM signal is provided to the LED driver module 225 where first and second LED drive signals are generated based on the second PWM signal (step 435). In some implementations, the first and second LED drive signals have substantially the same value when the duty cycle of the second PWM signal corresponds to a dimming level below a threshold dimming value (e.g., less than approximately 90% dimming). Then, when the dimming level exceeds or is above the threshold dimming value (e.g., greater than approximately 90% dimming), the first and second LED drive signals differ such that a first group of LEDs will turn off prior to, or at a different rate than, a second group of LEDs. After step 435, the first and second groups of LEDs are driven by the first and second LED drive signals (step 440). In some implementations, the lighting system 100 includes more than two groups of LEDs and the LED driver module 225 generates a corresponding number of LED drive signals. In such implementations, the number of drive signals generated by the LED driver module 225 corresponds to the number of groups of LEDs being driven in the lighting system 100.

Figure 12:
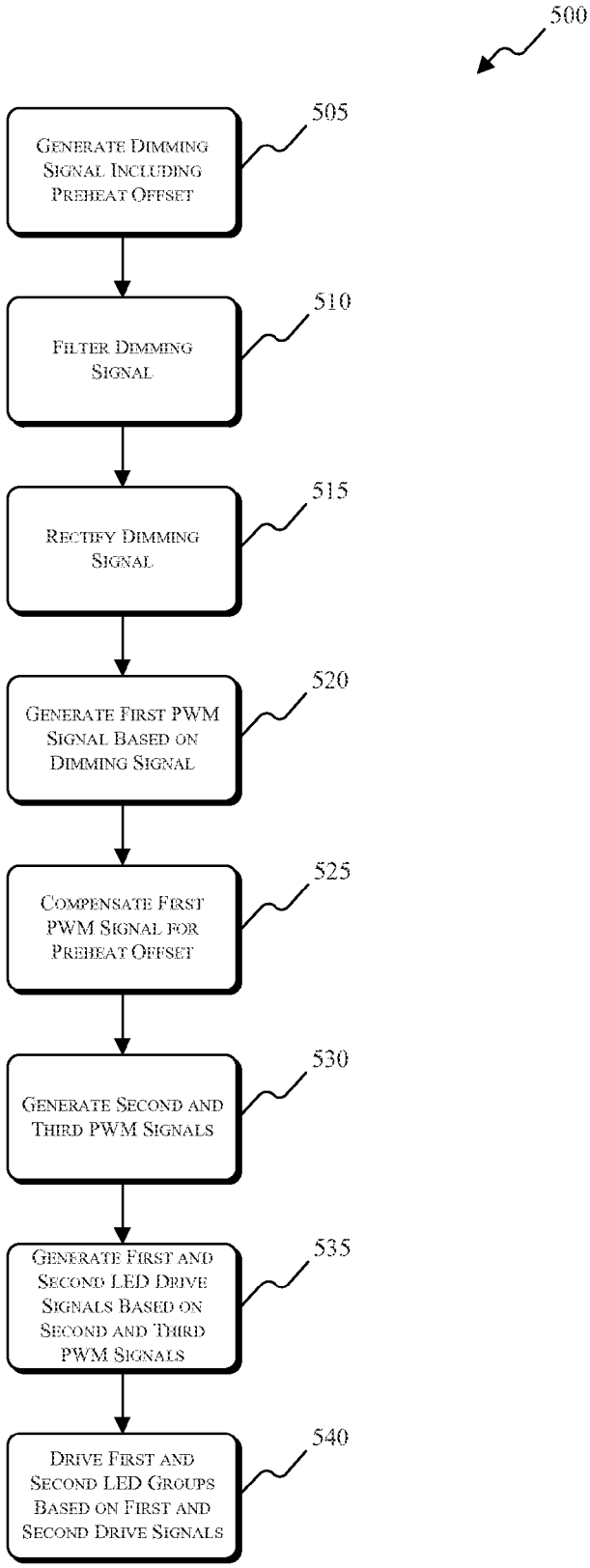
FIG. 12 illustrates a process for controlling the dimming of a lighting system according to another embodiment of the invention.

FIG. 12 illustrates another process 500 for enhancing low-end dimming of a lighting system. At step 505, a dimming signal is generated that includes an offset from the preheat function of the dimmer 120, as described above. The generated dimming signal is received by the controller 105 and filtered (step 510) by the line filter 205 to remove or reduce noise in the dimming signal (e.g., a voltage signal). The filtered dimming signal is then rectified (step 515). The rectified dimming signal is received at the dimmer controller 215, which generates a first PWM signal (step 520) based on the rectified dimming signal. The first PWM signal is provided to the software controller 230, which compensates the duty cycle of the first PWM signal for the preheat function of the dimmer 120 (step 525). For example, the duty cycle of the first PWM signal is determined and reduced in correspondence with the magnitude of the voltage or current offset from the preheat function. The software controller 230 then generates a second PWM signal and a third PWM signal having duty cycles that are based on the compensated first PWM signal (step 530). The second PWM signal and the third PWM signal are provided to the LED driver module 225 where first and second LED drive signals are generated based on the second PWM signal and the third PWM signal, respectively (step 535). In some implementations, the first and second LED drive signals have substantially the same or similar values when the duty cycle of the second PWM signal and the third PWM signal correspond to dimming values that are below a threshold dimming value (e.g., less than approximately 90% dimming). Then, when the dimming level of the second PWM signal and/or the third PWM signal exceeds the threshold dimming value (e.g., greater than approximately 90% dimming), the first and second LED drive signals differ such that a first group of LEDs will turn off prior to, or at a different rate than, a second group of LEDs. After step 535, the first and second groups of LEDs are driven by the first and second LED drive signals. In some implementations, the lighting system 100 includes more than two groups of LEDs, the software controller 230 generates a corresponding number of PWM signals, and the LED driver module generates a corresponding number of LED drive signals. In such implementations, the number of PWM signals generated by the software controller 230 and the number of drive signals generated by the LED driver module 225 corresponds to the number of groups of LEDs being driven in the lighting system 100.

Thus, the invention provides, among other things, new and useful systems, methods, and devices for enhanced low-end dimming control and precision. Various features and advantages of the invention are set forth in the following claims.

What is claimed is:

1. A light-emitting diode ("LED") lighting system comprising:

a dimmer having a preheat function and configured to generate a dimming signal;

a first group of LEDs and a second group of LEDs, the first group of LEDs and the second group of LEDs configured to be independently driven by a first LED drive signal and a second LED drive signal, respectively;

a dimming controller configured to receive the dimming signal from the dimmer, and generate a first pulse-width modulated ("PWM") signal based on the dimming signal, the first PWM signal having a first duty cycle;

a software controller in electrical communication with the dimming controller, the software controller configured to receive the first PWM signal from the dimming controller, compensate the first PWM signal for the preheat function of the dimmer to generate a second PWM signal, the second PWM signal having a second duty cycle, the second duty cycle being different than the first duty cycle; and an LED driver module configured to receive the second PWM signal, generate the first LED drive signal based on the second PWM signal, the first LED drive signal associated with a drive level of the first group of LEDs, generate the second LED drive signal based on the second PWM signal, the second LED drive signal associated with a drive level of the second group of LEDs, and transmit the first LED drive signal to the first group of LEDs and the second LED drive signal to the second group of LEDs.

2. The lighting system of claim 1, wherein the first group of LEDs and the second group of LEDs are located in a first lighting fixture.

3. The lighting system of claim 1, wherein the second duty cycle is lower than the first duty cycle.

4. The lighting system of claim 1, wherein the LED drive module is further configured to determine whether the second PWM signal corresponds to a dimming level above a threshold dimming level.

5. The lighting system of claim 4, wherein the first LED drive signal and the second LED drive signal are different when the second PWM signal corresponds to a dimming level above the threshold dimming level.

6. A light-emitting diode ("LED") lighting system comprising:

a first group of LEDs and a second group of LEDs, the first group of LEDs and the second group of LEDs configured to be driven by a first LED drive signal and a second LED drive signal, respectively; and a controller in electrical communication with the first group of LEDs and the second group of LEDs, the controller configured to receive a dimming signal associated with a dimmer, the dimmer having a preheat function, compensate the dimming signal for the preheat function of the dimmer to generate a compensated dimming signal, generate the first LED drive signal based on the compensated dimming signal, the first LED drive signal associated with a drive level of the first group of LEDs, generate the second LED drive signal based on the compensated dimming signal, the second LED drive signal associated with a drive level of the second group of LEDs, and transmit the first LED drive signal to the first group of LEDs and the second LED drive signal to the second group of LEDs.

7. The lighting system of claim 6, wherein the first group of LEDs and the second group of LEDs are located in a first lighting fixture.

8. The lighting system of claim 6, wherein the controller is further configured to determine whether the compensated dimming signal corresponds to a dimming level above a threshold dimming level.

9. The lighting system of claim 8, wherein the first LED drive signal and the second LED drive signal are different when the compensated dimming signal corresponds to a dimming level above the threshold dimming level.

10. The lighting system of claim 8, wherein the threshold dimming level is between approximately 80% dimming and 100% dimming.

11. The lighting system of claim 6, wherein the controller includes a first LED drive module and a second LED drive module.

12. The lighting system of claim 11, wherein the first LED drive module generates the first LED drive signal and the second LED drive module generates the second LED drive signal.

13. A method of controlling dimming in a light-emitting diode ("LED") lighting system, the method comprising:

receiving a dimming signal;

generating a first pulse-width modulated ("PWM") signal based on the dimming signal, the first PWM signal having a first duty cycle;

compensating the first PWM signal for a preheat function of a dimmer to generate a second PWM signal, the second PWM signal having a second duty cycle, the second duty cycle being different than the first duty cycle;

generating a first LED drive signal based on the second PWM signal, the first LED drive signal associated with a drive level of a first group of LEDs;

generating a second LED drive signal based on the second PWM signal, the second LED drive signal associated with a drive level of a second group of LEDs; and transmitting the first LED drive signal to the first group of LEDs and the second LED drive signal to the second group of LEDs.

14. The method of claim 13, wherein the dimming signal includes a first half-cycle and a second half-cycle, and wherein the first half-cycle and the second half-cycle are independently controlled.

15. The method of claim 13, wherein the second duty cycle is lower than the first duty cycle.

16. The method of claim 13, further comprising determining whether the second PWM signal corresponds to a dimming level above a threshold dimming level.

17. The method of claim 16, wherein the first LED drive signal and the second LED drive signal are different when the second PWM signal corresponds to a dimming level above the threshold dimming level.

18. The method of claim 16, wherein the threshold dimming level is between approximately 80% dimming and 100% dimming.

19. The method of claim 13, further comprising generating a third LED drive signal based on the second PWM signal, the third LED drive signal associated with a drive level of a third group of LEDs.

20. The method of claim 19, further comprising transmitting the third LED drive signal to the third group of LEDs, the third group of LEDs located in the first lighting fixture.

* * * * *